United States Patent [19]

Fischer et al.

[11] 4,183,744

[45] Jan. 15, 1980

[54] METHOD OF FOAMING A LIQUID METAL

[75] Inventors: Albert K. Fischer, Western Springs; Carl E. Johnson, Elk Groove Village, both of Ill.

[73] Assignee: The United States of America as represented by the United States Department of Energy, Washington, D.C.

[21] Appl. No.: 929,144

[22] Filed: Jul. 28, 1978

[51] Int. Cl.[2] ..... C22B 5/02

[52] U.S. Cl. ..... 75/20 F; 252/512

[58] Field of Search ..... 310/10, 11; 75/20 F; 252/512

[56] References Cited

U.S. PATENT DOCUMENTS 3,549,915 12/1970 Prem ..... 310/11

OTHER PUBLICATIONS

"Surface Properties of Liquid Sodium and Sodium-Potassium Alloys in Contact with Metal Oxide Surfaces," D. H. Bradhurst and A. S. Buchanan, Australian Journal of Chemistry, 14, 1961, pp. 397–408.

"Liquid Metals, Part VI, The Surface Tension of Solutions of Barium and Calcium in Liquid Sodium," C. C. Addison, J. M. Coldrey, and W. D. Halstead, Journal of the Chemical Society, 1962, pp. 3868–3873.

*Primary Examiner*—L. Dewayne Rutledge
*Assistant Examiner*—John P. Sheehan
*Attorney, Agent, or Firm*—R. V. Lupo; Frank H. Jackson; James W. Weinberger

[57] ABSTRACT

The addition of a small quantity of barium to liquid metal NaK or sodium has been found to promote foam formation and improve bubble retention in the liquid metal. A stable liquid metal foam will provide a more homogeneous liquid metal flow through the channel of a two-phase liquid metal MHD power generator to improve operating efficiency.

6 Claims, No Drawings

METHOD OF FOAMING A LIQUID METAL

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to two-phase liquid metal magneto-hydrodynamic (MHD) power generators. More specifically, this invention relates to a method for promoting the formation of a foam and for improving bubble retention and foam lifetimes in liquid metal NaK or sodium used to generate power in two-phase liquid metal MHD generators.

In a two-phase liquid metal MHD generator, a compressed, hot, inert gas is used as the thermodynamic working fluid to electrically drive a conductive liquid metal such as NaK, sodium or tin through the generator channel. The gas and liquid are mixed together just as the mixture enters the generator channel so that the expansion of the gas drives the conductive liquid across the magnetic field, generating electrical power. The two phases are then separated and returned to the mixer through different loops.

One problem which has been found to cause MHD generator inefficiencies is the inhomogeneity of the fluid as it passes through the channel. This has been found to be caused by the movement of bubbles of working fluid away from the wall and the rapid coalescence of the bubbles at the center of the channel to form a fast moving gas phase leaving a slower moving annular flow or slug flow of liquid metal around the perimeter of the channel, increasing the ratio of boundary layer-to-core electrical conductivity, and limiting the achievement of high conversion efficiencies.

Ideally, the two-phase gas and liquid metal mixture should flow through the channel at the same velocity while maintaining a uniform void distribution throughout the liquid metal in order to achieve the power generation efficiencies necessary to make the system effective.

One solution to this problem which has been proposed would utilize the surface active property of dilute liquid metal solutions to permit creation of a foam flow which would then pass through the channel in a more or less homogeneous manner. In non-surface active or pure systems, coalescence of mutually encountering bubbles is virtually instantaneous, yielding a slug flow at void fractions higher than 25%. The addition of a small amount of surface active agent or agents that tend to concentrate at the interface, modifying the surface properties of surface tension and elasticity, and creating dynamic effects, may completely prevent coalescence of bubbles for a certain period of time. This may yield adequately stable, homogeneous foam flows with velocity slip ratios near unity at high void fractions.

Thus the problem is to find some element or compound which when added to two-phase liquid metal MHD fluid will promote the formation of liquid metal foams which are stable for a sufficient period of time to provide improved void fractions and gas dispersion as the foam passes through the MHD generator channel, thereby improving generator performance and efficiency.

SUMMARY OF THE INVENTION

It has been found that the addition of a small amount of barium to liquid metal NaK or sodium will promote the formation of foam in the liquid metal and will inhibit the coalescence of bubbles in the foam for a substantial period of time after the foam has been formed. By the process of the invention for the formation of foam in a liquid metal, an effective amount of barium to promote foam formation is added to the liquid metal and an inert gas is bubbled through the liquid metal containing the barium whereby a foam of liquid metal is formed having substantial bubble stability.

It is therefore one object of the invention to provide a method for forming foams of liquid metals.

It is a further object of the invention to provide a method for forming foams of the liquid metals used in two-phase liquid metal MHD power generators.

Finally it is the object of the invention to provide a method for forming foams of liquid metal sodium and NaK which may be used in two-phase liquid metal MHD power generators.

DESCRIPTION OF THE PREFERRED EMBODIMENT

These and other objects of the invention for forming a foam of liquid metal sodium or NaK may be met by adding to the liquid metal to be foamed from about 0.05 to 1.0 weight percent barium, and bubbling an inert gas into the liquid metal containing the barium, whereby a foam is formed of the liquid metal which has improved bubble retention characteristics.

The quantity of barium which must be added to the liquid metal must be an amount effective to promote the formation of a foam and is dependent to some extent upon the particular liquid metal. In general, a minimum of about 0.05 weight percent barium is necessary to promote foam formation while the maximum may range up to the solubility limit of barium in the particular liquid metal, although any undissolved excess was not found to have any detrimental effect on foam formation. The preferred range of barium concentration in NaK (77 weight percent K) is from about 0.1 to 0.5 weight percent while in sodium alone, it may vary up to about 1.0 weight percent.

The liquid metal may be either sodium or NaK which may vary greatly in composition. Generally the eutectic NaK which contains 77 weight percent potassium is used because of the low melting temperature, although the sodium to potassium ratio may vary substantially from this figure without any detrimental effect upon the foam promoting ability of the barium, except that slightly more barium may be required as the potassium content is decreased.

The gas may be any gas which is inert to both the liquid metal and to the barium, such as helium, argon or nitrogen. Although nitrogen is known to react with barium, there has been no indication of such reactions at the concentrations at which the barium is present in the liquid metals at room temperature. The temperature range within which the presence of barium promotes the formation of liquid metal foams varies from ambient to about 250° C., although due to increased solubility, the higher temperatures may require slightly more barium.

EXAMPLE

In order to investigate a number of different materials known or thought to have surfactant properties in liquid metal sodium, varying amounts of a number of these materials were added to liquid metal NaK and nitrogen gas was bubbled through the liquid metal while foam formation and bubble retention were observed. The bubbles were formed by passing the gas into the liquid metal either from an L-shaped stainless steel tube through a 0.04-inch hole at a rate of about 5 cc per minute or from a 20 to 25 cc syringe at a rate of up to 30 cc per minute. The results are given in the table below.

| Liquid Metal | Temp | Surfactant (amount weight percent) | Gas flow rate | Foam formed | Bubble |
|---|---|---|---|---|---|
| NaK (77 w/o K) | Ambient | Mercury (2.1 to 28.9 w/o) | 5 cc/min | No | Some bubbles formed. |
| " | " | Cesium (.0114, 0.41 and 0.57 w/o) | " | No | Some enhancement of bubble lifetimes. |
| " | " | Sulfur (.051 w/o) | " | No | 5 coexisting bubbles - 10 sec. to burst. |
| " | " | Selenium (0.13 w/o) | " | No | Some bubbles formed - more favorable than sulfur. |
| " | " | Barium (.45 w/o) | " | Yes | Column of bubbles several cms high observed. Surface coverage of 5 cm in diameter - first indication of material which would result in foam formation. |
| " | " | Dicyclopentadiene | " | No | Somewhat favorable bubble lifetimes. |
| " | " | Calcium | " | No | No bubbles formed. |
| " | " | Barium (0.22 w/o) | 5-300 cc/min | Yes | Supported surface coverage of bubbles immediately on start of gas flow. One bubble persisted over 2 minutes. |
| " | " | Magnesium (.005 to .11 w/o) | 5 cc/min | No | Some bubbles could coexist at low concentrations. The addition of Ba permitted bubble formation with persistence to 3-5 secs. |
| NaK (85 w/o K) | " | Barium (0.16 w/o) | 5-300 cc/min | Yes | Bubbles covered half of surface and persisted 3-5 secs. |
| NaK (77 w/o K) | " | Silicon (.08 w/o) | 5 cc/min | No | Some bubbles formed - addition of Ba showed improved performance. |
| " | " | Lead (.083 w/o) | " | No | About ⅓ surface covered with bubbles - some existing 8-10 secs. |
| | | 0.18 w/o Ba added | | No | ½ surface covered with bubbles. |
| " | " | Gallium | 5 cc/min | No | Some surface coverage of bubbles. |
| " | " | Cadmium | " | No | Some surface coverage of bubbles. |
| | | 0.2 w/o Ba added | | No | No change. |
| | | 0.43 w/o Ba added | | No | No change. |
| | | 0.7 w/o Ba added | | No | Bubbles formed - apparently Ba formed compounds with Cd. |
| " | " | Selenium | " | No | Only few bubbles. |
| | | 0.17 w/o Ba added | " | No | No effect. |
| | | 0.34 w/o Ba added | " | Yes | Covered with bubbles lasting 5-7 min. |
| " | 220° C. | Barium (.43 w/o) | 5-300 cc/min | Yes | Bubbles larger - half of surface covered. Lasted about 5 sec. |
| " | 188° C. | Barium (.15 w/o) | " | No | Bubbles large - no persistence - apparently need higher concentration Ba at higher temperatures. |
| NaK (46 w/o K) | Ambient | Barium (.072 w/o) | 5-300 cc/min | Yes | Bubbles formed easily - covering surface and lasting 35-45 secs. |
| NaK (85. w/o K) | " | Barium (.16 w/o) | " | Yes | Bubbles covered half the surface and lasted 3-5 secs. |

As can be seen from the preceding example, the addition of small quantities of barium to the liquid metal had a substantial effect both upon the formation of foams from the material and on the persistence of the bubbles which make up the foam. Thus the addition of barium to the liquid metal NaK or sodium used in closed cycle two-phase liquid metal MHD generators can provide a method for forming stable homogeneous foams which will provide a substantial improvement in the operating efficiency of these generators.

The embodiments of the invention in which an exclusive property or privilege is claimed are defined as follows:

1. A method for forming a foam of liquid metal comprising:

adding to a liquid metal consisting of an alloy of sodium and potassium an effective amount of barium to promote the formation of foam; and passing an inert gas at a bubble forming rate through the liquid metal containing the barium, thereby forming a foam of the liquid metal.

2. The method of claim 1 wherein the liquid metal contains at least 0.05 weight percent barium.

3. The method of claim 2 wherein the liquid metal contains up to the solubility limit of barium in the liquid metal.

4. The method of claim 3 wherein the inert gas is selected from the group consisting of argon, helium and nitrogen.

5. The method of claim 4 wherein the temperature of the liquid metal is from ambient to 250° C.

6. The method of claim 5 wherein the liquid metal contains from 0.05 to 0.5 weight percent barium.

* * * * *